United States Patent [19]

Ray, Jr. et al.

[11] 3,951,572

[45] Apr. 20, 1976

[54] APPARATUS FOR PUMPING CEMENT SLURRY

[76] Inventors: Jess B. Ray, Jr., 3150 E. 62 St., Tulsa, Okla. 74136; Billie Eugene Nourse, Rte. 4, Bristow, Okla. 74145

[22] Filed: July 8, 1974

[21] Appl. No.: 486,382

[52] U.S. Cl. ..... 417/389; 417/478; 417/900

[51] Int. Cl.[2] ..... F04B 9/08; F04B 35/02; F04B 43/08; F04B 15/02

[58] Field of Search ..... 417/389, 394, 478, 900

[56] References Cited

UNITED STATES PATENTS

| | | | |
|---|---|---|---|
| 1,282,145 | 10/1918 | Tobler | 417/394 X |
| 3,174,649 | 3/1965 | Richardson | 417/403 X |
| 3,250,226 | 5/1966 | Voelker | 417/900 X |
| 3,289,607 | 12/1966 | Delligatti | 417/478 X |
| 3,427,987 | 2/1969 | Eull | 417/394 |
| 3,526,223 | 9/1970 | Curtis | 417/394 X |
| 3,609,067 | 9/1971 | Wright | 417/389 |
| 3,814,547 | 6/1974 | Kitrikkis et al. | 417/478 X |

FOREIGN PATENTS OR APPLICATIONS

| | | | |
|---|---|---|---|
| 1,350,149 | 12/1963 | France | 417/389 |
| 1,007,631 | 5/1957 | Germany | 417/389 |

*Primary Examiner*—Carlton R. Croyle
*Assistant Examiner*—Richard E. Gluck
*Attorney, Agent, or Firm*—Head & Johnson

[57] ABSTRACT

A system for pumping cement slurry comprising two pumps connected in parallel in a piping system, each pump comprising a flexible tubular bladder connected between two tubular elements and surrounded by a cylindrical housing so as to provide a closed annular space between the bladder and the housing. There is an inlet check valve and an outlet check valve on each of the two pumps. Pressure fluid is provided by a cylinder and power driven piston, which oscillates in the cylinder, from one end to the other. Each end of the cylinder is connected to one of the two annular spaces so that when the annular spaces and the cylinder are filled with pressure fluid, oscillation of the piston will cause sequential compression and expansion of the bladders, and pumping of cement slurry through the inlet check valves and out of the outlet check valves providing a substantially constant flow of slurry.

1 Claim, 3 Drawing Figures

APPARATUS FOR PUMPING CEMENT SLURRY

BACKGROUND OF THE INVENTION

This invention lies in the field of pumping systems. More particularly, it concerns a pumping system for pumping mineral aggregate slurries. Still more particularly, it is of the flexible bladder construction so as to minimize damage to the pump parts by the abrasive material in the slurry.

In the prior art efforts have been made to design rubber faced rotary pumps and similar types of pumping apparatus for handling abrasive slurry mixtures. These are expensive to construct, and to replace the worn parts as they wear.

SUMMARY OF THE INVENTION

It is a primary object of this invention to provide a pumping system in which expendable parts can be inexpensive in construction, and easy to replace.

These and other objects are realized and the limitations of the prior art are overcome in this invention by providing two pumps connected in parallel into a pumping line through Y connections. Each of the pumps comprises a flexible cylindrical tubular bladder made of wear resistant material, which is clamped by simple means to the two spaced ends of an inlet pipe and an outlet pipe. The bladder is surrounded by a cylindrical metal housing which is sealed respectively to the inlet and to the outlet pipes, providing a closed annular space between the bladder and the housing. There is an inlet check valve and an outlet check valve in appropriate positions, so that by providing a pulsating fluid pressure in the annular space, the bladder will be alternately compressed and expanded, changing the internal volume of the bladder in such a way, in conjunction with the check valve, as to draw liquid into the bladder through the inlet check valve, and to expel it through the outlet check valve. Fluid pressure means are provided to supply pulsating pressurized fluid successively to each of the two annular spaces so that while one bladder is drawing in slurry through the inlet valve, the other bladder is expelling slurry into the outlet line through the outlet valve, and thereby maintaining a substantially constant flow of material.

BRIEF DESCRIPTION OF THE DRAWINGS

These and other objects and advantages of this invention and a better understanding of the principles and details of the invention will be evident from the following description taken in conjunction with the appended drawings in which.

DESCRIPTION OF THE PREFERRED EMBODIMENT

Figure 1:
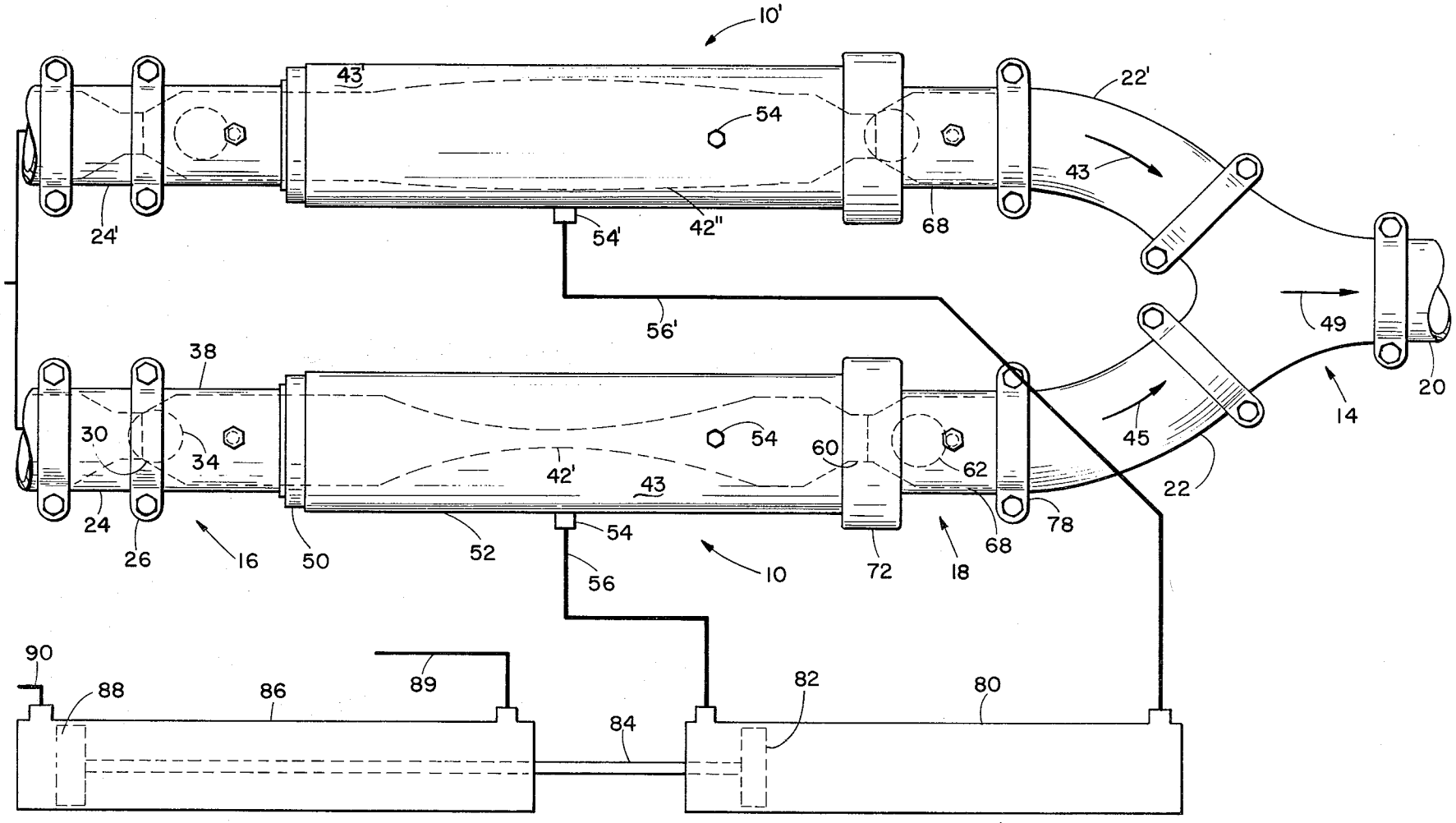
FIG. 1 represents an overall view of the pumping system.

Referring now to the drawings there is shown in FIG. 1 an overall view of the pumping system. This comprises two pumps indicated generally by the numerals 10 and 10', connected in parallel through the medium of two Y connections indicated generally by the numeral 14 in a material supply line (not shown). Each pump comprises an inlet pipe indicated generally by the numeral 16 containing an inlet ball check valve 34 resting in a valve seat 30. There is an outlet pipe indicated generally by the numeral 14 which includes an outlet ball check valve 62 which rests in a seat 60. There is a cylindrical flexible bladder 42 which is clamped at its inlet and to the inlet pipe 16 and at its outer end to the outlet pipe 14. A housing 52 which is of cylindrical tubular metal construction, surrounds the bladder and is sealed at its inlet and outlet end to the inlet system and the outlet system 16 and 14, respectively.

Fluid power means indicated generally by the numeral 12 alternately supplies pressure fluid to one and the other of the annular spaces between the bladder and the housing of each of the two pumps, so as to successively compress and inflate the rubber bladder and thereby discharge and draw in slurry through the inlet check valves and force it out through the outlet check valves into the delivery line.

Figure 3:
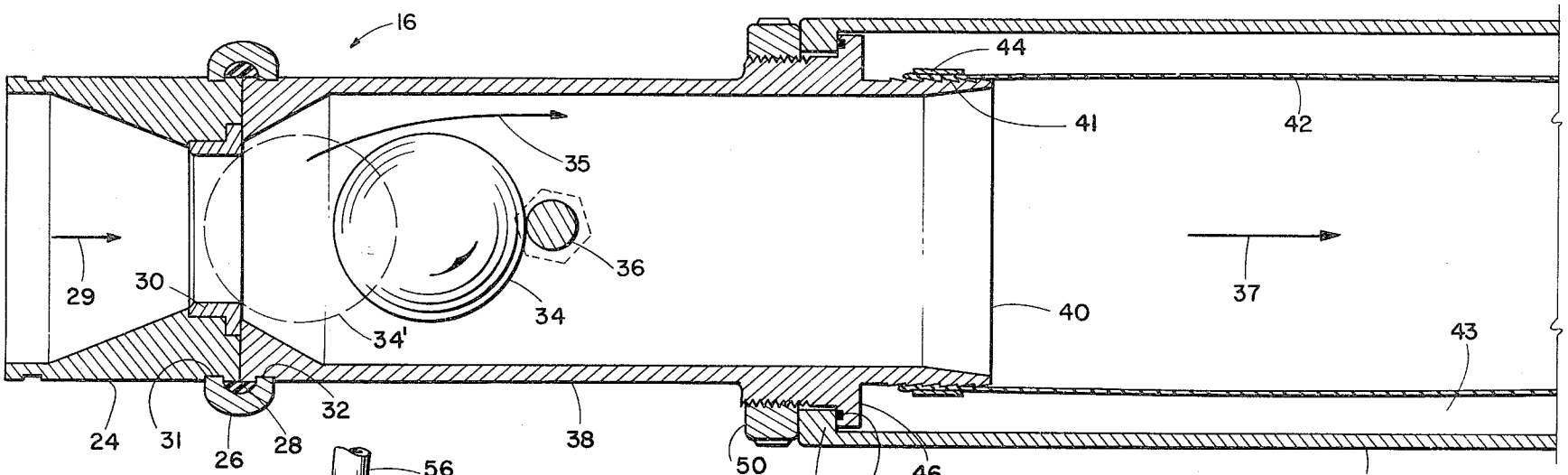
FIG. 3 is a view of the pumping section and the inlet check valve.

Referring now to FIG. 3 there is shown an inlet valve pipe section 24 which supports a valve seat 40 in its upper surface. The valve section 24 is coupled to an inlet pipe 38 section by any convenient means such as the sealed coupling 26, which locks the two sections of pipe together by means of notches 31 and 32 in the respective pipes, and a deformable seal material 28. The inlet pipe 38 has a base portion which serves to lock the valve seat 30 into the portion 24, and provide a guide for the valve ball 34, to seat in the position 34'. Means are provided such as a rod or bolt 36 which is passed through and sealed in the inlet pipe 38, so as to retain the check ball 34 in the space between the bolt 36 and the seat 30.

The second end 40 of the inlet pipe 38 has an edge in the form of a roughened surface 41. The flexible tubular bladder 42 is of such a dimension as to conveniently slide over the end 40 and to engage the rough surface 41. Circumferential clamp means 44, which can conveniently be a screw type clamp of conventional design, surrounds the bladder and clamps it tightly to the surface 41 of the inlet pipe, and locks it so that it cannot easily be removed by fluid pressure.

Figure 2:
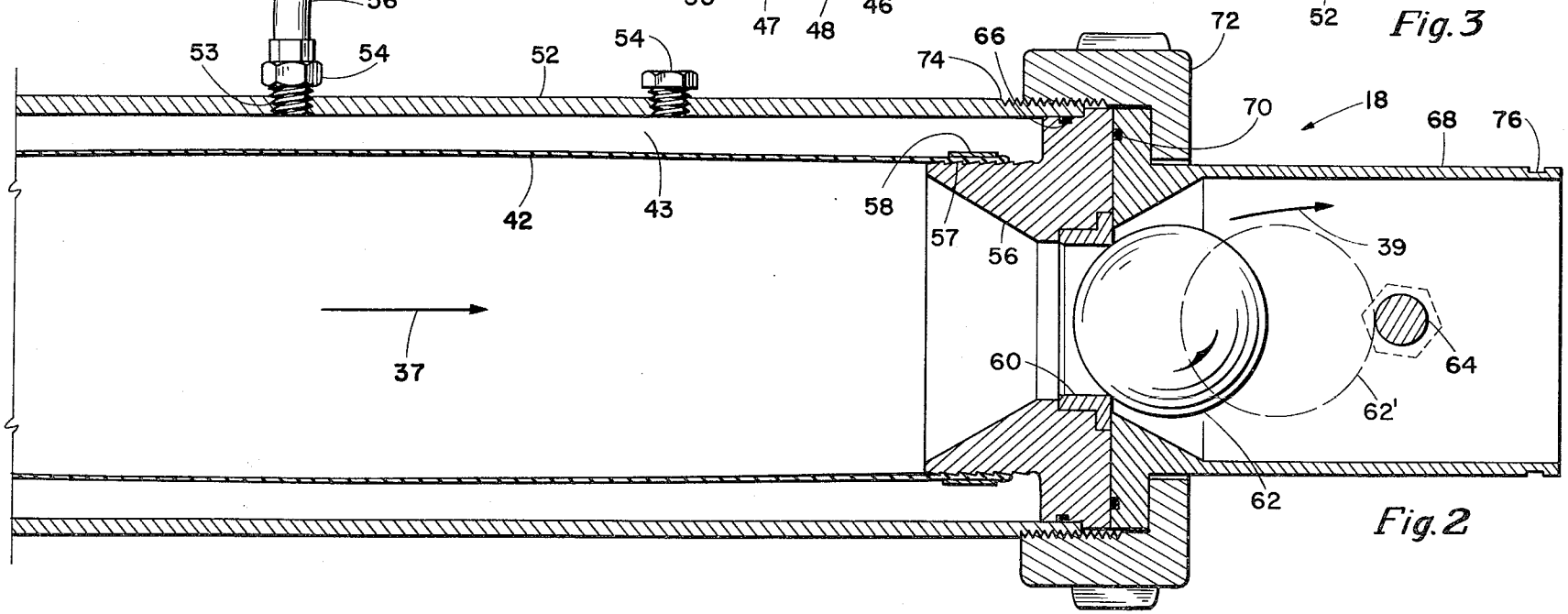
FIG. 2 is a detailed drawing of the pumping section and the outlet check valve.

In FIG. 2 is shown the upper end of the bladder 42 which is similarly clamped to a circular ring portion 56 which carries an outlet ball check seat 60, against which seats a spherical check ball 62. Bolt means 64 is similarly provided in the outlet section 68 so as to retain the check ball 62 within the space between the bolt 64 and the seat 60.

The inlet pipe 38 extension 40 to which the bladder 42 is clamped, and the length of the bladder 42 and the outlet valve seat portion 56 are of such dimensions that a cylindrical tubular housing 52 can be inserted over and positioned in a surrounding manner around the bladder 42. The housing 52 has an inner shoulder 47 which seats against a corresponding shoulder 46 on the inlet tube 38 and is sealed by means 48. The shoulder 47 is retained against the shoulder 46 by means of a threaded ring 50.

As in FIG. 2 the housing 52 is of such a length that it locks into and supports the outlet check valve seat portion 56. An outlet pipe 68 is positioned on the outlet valve seat portion 56 and is sealed thereto by means 70 and is clamped to it by means of a threaded ring 72, engaging threads on the outside surface of the housing 52.

Thus it is seen that the pumping units are comprised of an inlet pipe carrying an inlet check valve, a central bladder portion clamped at one end to the inlet pipe and at the other end to the outlet check valve, and a surrounding housing which is clamped at one end to the inlet pipe and at the other end to the outlet check valve seat portion and is clamped rigidly to an output pipe portion 68, which contains an outlet check valve. The annular space 43 between the bladder 42 and the housing 52 is completely sealed at each end. By attaching a tubular conduit 56 through means 54 such as a screw thread element 53, pressure fluid can be inserted into the annular space 43 to compress the bladder 42 into the shape shown dashed in FIG. 1 and labeled 42'. Then when the pressure fluid is withdrawn, the bladder expands to the bulging shape 42'' in FIG. L, so that successive pulsation of high pressure and low pressure will compress and dilate the bladder, which in conjunction with the inlet and outlet check valves will provide a pumping action.

In FIG. 1 it is shown how the outlet pipe sections 68 can be coupled by means 78 which are similar couplings to that labeled 26 in FIG. 3, to a Y section of piping, identified by numeral 20. This has two legs 22 and 22', for example. There is a similar Y section (not shown) connected ahead of the inlet valve pipes 24 and 24', so that a single supply line would diverge into two legs, connected to the input valve sections 24, 24', through the inlet check valves 34 and inlet pipes 38, the pumping sections 10, the pumping bladders 42, the outlet valves 62, through the Y 14 into the outlet pipe 20. Since there are alternate pumping actions of the two pumps there will be a substantially constant flow of material to the outlet line 20.

Liquid will flow into the inlet valve in accordance with arrow 29 and will pass through the inlet check valve 34 in accordance with the arrow 35, into the volume inside the bladder 42 in accordance with arrow 37 and out through the outlet check valve 62 in accordance with arrow 39, through the legs of the Y 14 in accordance with arrows 43 and 45 and out through the outlet line 20 in accordance with arrow 49.

Also shown in FIG. 1 is a pressure cylinder indicated generally by the numeral 12. This consists of a cylinder 80, piston 82 with piston rod 84, and two connections to the cylinder, one at either end. One is connected by conduit 56 to an input connection 54 into the annular space 43 around the bladder 42', while the other end of the cylinder 80 is connected through conduit 56' to a fixture 54' connected to the annular space 43' around the bladder 42''. It will be clear that oscillation of the piston rod 84 axially, forward and backward, along the cylinder 80 will cause the bladders 42' and 42'' alternately to pump liquid slurry through the respective pumps 10 and 10' and into the outlet line.

The piston rod 84 can be driven by any conventional means, such as a pressure cylinder 86 having a piston 88 and inlet and outlet ports 80 and 90 for example. Conventional hydraulic fluid can be used to drive the piston 88 which then drives the piston 82 supplying closed circuit pressure fluid between the cylinder 80 and the two annular spaces 43 and 43'.

It will be clear also that the piston rod can be driven by a crank and connecting rod system, or other conventional means such as rack and pinion drive, etc. as is well known in the art. It is also clear that the fluid pressure connections 54 and 54' can be supplied alternately with high and low pressure connections from a high pressure reservoir and a low pressure reservoir by means of conventional hydraulic valving systems.

In FIG. 2 is shown a plug 64 inserted into an opening in the housing 52. Such plugs are also shown in FIG. 1. These are for the purpose of bleeding the annular spaces 43 so as to fill such spaces with pressure fluid in setting up the closed system involving the annular spaces and the cylinder 80.

While the invention has been described with a certain degree of particularity it is manifest that many changes may be made in the details of construction by the arrangement of components. It is understood that the invention is not to be limited to the specific embodiment set forth herein by way of exemplifying the invention, but the invention can be limited only by the scope of the attached claim or claims, including the full range of equivalency to which each element or step thereof is entitled.

What is claimed is:

1. A cement slurry pumping system comprising:

a. first and second apparatus for pumping a slurry of cement particles and water, each apparatus comprising 1. inlet tubular means having an inlet ball check valve at a first end including means to restrain said ball means to the vicinity of the valve seat;
2. flexible tubular bladder means and circumferential clamp means to sealably attach said bladder means, at a first end, to the second end of said inlet means, outlet check valve seat means attached to the second end of said bladder means by circumferential clamp means;
3. rigid cylindrical housing means removably attached at its first end to said inlet means, said housing means of larger diameter than and surrounding said bladder means, providing an annular space therebetween, said housing means supporting said outlet check valve seat means, said clamp means being in said annular space; and
4. outlet tubular means and outlet ball valve means removably attached to said housing means and coupled to said outlet check valve seat means, and including means to restrain said ball means to the vicinity of said seat means;

b. additional tubular means to couple both of said inlet tubular means to an inlet pipe means and to couple both of said outlet tubular means to an outlet pipe means, the internal surfaces of said inlet tubular means, inlet check valve, said bladder means, said outlet check valve seat means, and said additional tubular means being contoured to prevent accumulations of cement slurry in pockets, said means to couple said inlet means and said means to couple said outlet means comprising a Y-shaped means, said first and second apparatus being positioned parallel and adjacent to each other;

c. cylinder means and piston means sealably slidable in said cylinder means, and piston rod means attached to said piston means;

d. first conduit means connected from a first end of said cylinder means to said first annular space, and second conduit means connected from the second end of said cylinder means to said second annular means, said cylinder, conduits and annular spaces filled with pressure fluid; and e. means to cyclically oscillate said piston rod to apply fluid pressure to each of said annular spaces in a manner so that high pressure is applied to a first annular space while low pressure is applied to the second annular space and vice versa.

* * * * *